US009506687B2

(12) United States Patent
Li et al.

(10) Patent No.: US 9,506,687 B2
(45) Date of Patent: Nov. 29, 2016

(54) REFRIGERATION DEVICE

(71) Applicants: HEFEI HUALING CO., LTD., Hefei (CN); HEFEI MIDEA REFRIGERATOR CO., LTD., Hefei (CN)

(72) Inventors: Pingfang Li, Hefei (CN); Hong Zuo, Hefei (CN)

(73) Assignees: Hefei Hualing Co., Ltd., Anhui (CN); Hefei Midea Refrigerator Co., Ltd., Anhui (CN)

( * ) Notice: Subject to any disclaimer, the term of this patent is extended or adjusted under 35 U.S.C. 154(b) by 0 days.

(21) Appl. No.: 14/896,830

(22) PCT Filed: Jun. 8, 2013

(86) PCT No.: PCT/CN2013/077011

§ 371 (c)(1),
(2) Date: Dec. 8, 2015

(87) PCT Pub. No.: WO2014/194531

PCT Pub. Date: Dec. 11, 2014

(65) Prior Publication Data

US 2016/0178272 A1 Jun. 23, 2016

(51) Int. Cl.

| | |
|---|---|
| ***A47B 96/04*** | (2006.01) |
| ***F25D 23/08*** | (2006.01) |
| ***F25D 23/02*** | (2006.01) |

(52) U.S. Cl.

CPC ..... *F25D 23/087* (2013.01); *F25D 23/026* (2013.01); *F25D 23/028* (2013.01); *F25D 2400/10* (2013.01)

(58) Field of Classification Search

CPC ..... F25D 23/087; F25D 23/028

USPC ..... 49/489.1, 495.1, 470

See application file for complete search history.

(56) References Cited

U.S. PATENT DOCUMENTS 4,617,759 A * 10/1986 Pasqualini ..... F25D 23/082 312/405
5,143,772 A * 9/1992 Iwasa ..... B29C 47/0023 264/45.9

(Continued)

FOREIGN PATENT DOCUMENTS

CN 2341095 Y 9/1999
CN 102245984 A 11/2011

(Continued)

OTHER PUBLICATIONS

PCT/CN2013/077011, English Translation of the International Search Report and Written Opinion, mailed Mar. 30, 2014, 9 pages.

*Primary Examiner* — Daniel J Troy
*Assistant Examiner* — Kimberley S Wright
(74) *Attorney, Agent, or Firm* — Lathrop & Gage LLP

(57) ABSTRACT

Disclosed is a refrigeration device, comprising: a shell (1) having an open top portion; a door body (2) configured to open and close the shell (1) and pivotally connected to the top portion of the shell (1), in which the door body (2) comprises a door liner (21), a groove (211) recessed upwardly is formed on a lower surface of the door liner (21); a door seal (3), in which an upper portion of the door seal (3) is snapped in the groove (211), a lower portion of the door seal (3) is pressed against the top portion of the shell (1) hermetically when the door body (2) is closed, and an air passage (4) is formed between the door seal (3) and the groove (211) when the door body (2) is subjected to an upward external force.

12 Claims, 7 Drawing Sheets

(56) References Cited

U.S. PATENT DOCUMENTS 5,214,877 A * 6/1993 Kaspar ..... A47F 3/043 312/296
5,428,968 A * 7/1995 Tetsukawa ..... A47F 3/0404 312/116
6,227,634 B1 * 5/2001 Cittadini ..... F25D 23/087 277/630
6,266,970 B1 * 7/2001 Nam ..... F25D 21/04 312/406
6,526,698 B2 * 3/2003 Park ..... F25D 23/087 49/489.1
7,147,292 B2 * 12/2006 Lee ..... F25D 23/087 312/296
7,171,785 B1 * 2/2007 Kelly ..... B60J 10/235 49/377
7,204,568 B2 * 4/2007 Lim ..... F25D 23/087 277/645
7,556,324 B2 * 7/2009 Benz ..... F25D 17/047 16/412
7,726,754 B2 * 6/2010 Keller ..... F25D 17/047 312/296
7,914,094 B2 * 3/2011 Wood ..... F25D 23/087 312/296
8,147,017 B2 * 4/2012 Casoli ..... F25D 23/087 312/406
8,869,493 B2 * 10/2014 Chubb ..... E06B 7/16 312/138.1
8,944,539 B2 * 2/2015 Ramm ..... F25D 23/087 312/296
9,016,031 B2 * 4/2015 Chubb ..... E06B 7/16 312/138.1
9,279,609 B2 * 3/2016 Kim ..... F25D 23/028
2002/0184828 A1 * 12/2002 Park ..... F25D 23/087 49/489.1
2003/0222553 A1 * 12/2003 Lee ..... F25D 23/087 312/296
2004/0244297 A1 * 12/2004 Schuster ..... F16J 15/027 49/478.1
2005/0081555 A1 4/2005 Seiss
2005/0242529 A1 * 11/2005 Kim ..... F25D 23/087 277/628
2006/0021284 A1 * 2/2006 Benz ..... F25D 17/047 49/477.1
2006/0188690 A1 * 8/2006 Jun ..... C08L 23/10 428/99
2008/0231158 A1 * 9/2008 Keller ..... F25D 17/047 312/405
2008/0276540 A1 * 11/2008 Kim ..... F25D 23/087 49/478.1
2009/0199588 A1 * 8/2009 Laible ..... F16K 15/141 62/449
2009/0241585 A1 * 10/2009 Diebold ..... F25D 23/087 62/406
2009/0277096 A1 * 11/2009 Ramos ..... F25D 23/087 49/478.1
2009/0314028 A1 * 12/2009 Laible ..... E05C 19/161 62/449
2010/0307189 A1 * 12/2010 Keller ..... F25D 17/047 62/449
2011/0220663 A1 * 9/2011 Guba ..... F25D 17/047 220/592.02
2012/0319551 A1 * 12/2012 Ramm ..... F25D 23/087 312/405
2013/0239484 A1 * 9/2013 Chubb ..... E06B 7/16 49/70
2014/0103791 A1 * 4/2014 Cheon ..... F25D 23/028 312/405
2015/0020451 A1 * 1/2015 Chubb ..... E06B 7/16 49/70
2015/0107160 A1 * 4/2015 Ramm ..... F25D 23/087 49/483.1

FOREIGN PATENT DOCUMENTS

CN 102564023 A 7/2012
CN 103398527 A 11/2013
CN 103453711 A 12/2013
FR 2445916 A1 8/1980
JP 2002277153 A 9/2002

* cited by examiner

REFRIGERATION DEVICE

CROSS REFERENCE TO RELATED APPLICATION

This application is a U.S. national phase application of International Application PCT/CN2013/077011, with an international filing date of Jun. 8, 2013, the entire contents of which are incorporated herein by reference.

FIELD

The present disclosure generally relates to a refrigeration device.

BACKGROUND

A leakage of cool air in a refrigeration device may affect a cooling effect and cause large energy consumption, an inefficiency and a poor effect for storing food, meanwhile a condensation phenomenon exists. In the related art, in order to reduce the leakage of cool air, a fit clearance between a door liner and an outer frame of a shell in a freezer product is designed to be very small and a door seal has a good sealing performance.

However, outside hot air may enter into the freezer after a door body is opened, while an air temperature may be reduced after the door body is closed, which may result in a certain pressure difference between an inside and an outside of the freezer and a better sealing performance, so the door body is tightly adsorbed on the shell. In particular, for a refrigeration device having a volume of more than 200 liters and a foam layer of about 90 mm thickness, the door body is difficult to open. In this case, the door body may be opened only by knocking the clearance with an external object and waiting until the internal pressure and the external pressure are balanced.

SUMMARY

The present disclosure aims to solve at least one of the problems existing in the related art. For this purpose, an objective of the present disclosure is to provide a refrigeration device with a door body opened easily.

A refrigeration device according to embodiments of the present disclosure includes: a shell having an open top portion; a door body configured to open and close the shell and pivotally connected to the top portion of the shell, in which the door body includes a door liner, a groove recessed upwardly is formed on a lower surface of the door liner and is adjacent to and surrounds an outer edge of the lower surface of the door liner; a door seal, in which an upper portion of the door seal is snapped in the groove, a lower portion of the door seal is pressed against the top portion of the shell hermetically when the door body is closed, and an air passage is formed between the door seal and the groove when the door body is subjected to an upward external force.

With the refrigeration device according to embodiments of the present disclosure, by snapping the upper portion of the door seal in the door liner and generating a relative displacement relative to the door liner to form the air passage, such that the external air may enter into the shell, thus balancing the internal pressure and the external pressure of the shell. In this way, it is easy to open the door body and the sealing between the shell and the door body will not be affected when the door body is closed again. In addition, the refrigeration device according to embodiments of the present disclosure is simple to manufacture and low in cost.

In one embodiment of the present disclosure, the door seal includes: a claw member snapped in the groove; and an airbag member disposed below the claw member, in which the airbag member is pressed to the top portion of the shell to form a seal between the door body and the shell when the door body is closed.

Preferably, an upper portion of a cross-section of the groove is substantially semicircular and a lower portion of the cross-section of the groove is narrowed. Thus, after the claw member is snapped in the groove, it is difficult for the claw member to escape.

In one embodiment of the present disclosure, the refrigeration device further includes: a first convex portion and a second convex portion each correspondingly disposed in a portion of the groove, in which two ends of the claw member are pressed against the first convex portion and the second convex portion respectively after a portion of the claw member stretches into the groove, in which the air passage is formed between another portion of the claw member and another portion of the groove when the door body is subjected to the upward external force.

In one embodiment of the present disclosure, the first convex portion includes a plurality of first sub convex ribs, and the plurality of first sub convex ribs are disposed on an inner wall of a side of the groove at intervals to each other; the second convex portion includes a plurality of second sub convex ribs, and the plurality of second sub convex ribs are disposed in the groove at intervals to each other.

In one embodiment of the present disclosure, each first sub convex rib and each second sub convex rib are formed respectively by extending inwardly from an inner wall of a corresponding side of the groove.

Alternatively, the each first sub convex rib and the each second sub convex rib extend inwardly and horizontally. In this way, a processing is convenient and a manufacturing is simple.

Alternatively, the each first sub convex rib and the each second sub convex rib extend inwardly and tilt upwardly or downwardly, respectively. In this way, the claw member pressing against the first sub convex rib hermetically and pressing against the second sub convex rib hermetically may be more compact.

In one embodiment of the present disclosure, the first sub convex rib and the second sub convex rib are symmetrical with respect to the door seal therebetween.

In another embodiment of the present disclosure, the first sub convex rib and the second sub convex rib are staggered with respect to the door seal therebetween.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
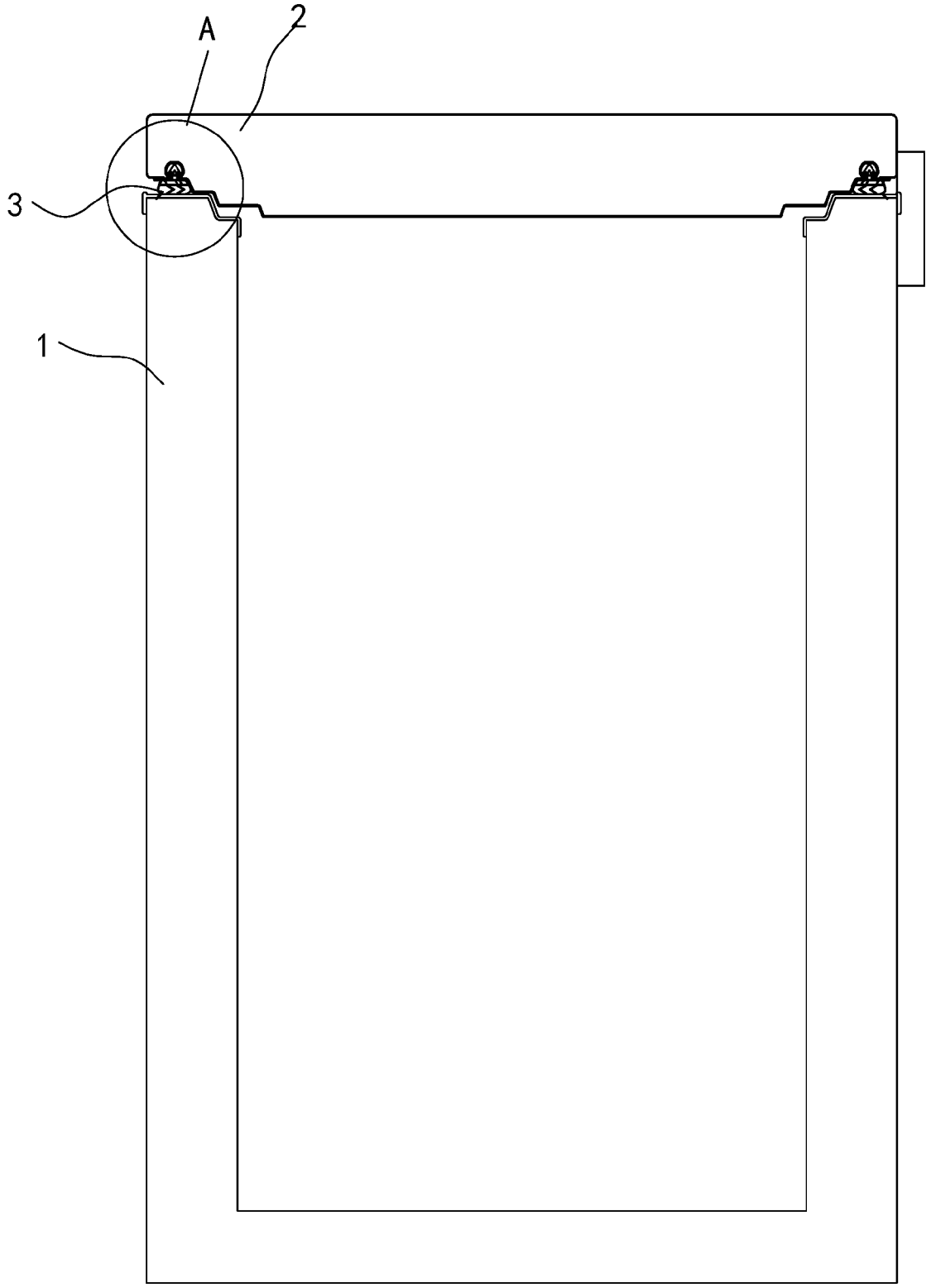
FIG. 1 is a schematic diagram of a refrigeration device according to an embodiment of the present disclosure, of which a door body is in a close state.

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

In the specification, unless specified or limited otherwise, relative terms such as "central", "longitudinal", "lateral", "front", "rear", "right", "left", "inner", "outer", "lower", "upper", "horizontal", "vertical", "above", "below", "up", "top", "bottom" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation. In addition, terms such as "first" and "second" are used herein for purposes of description and are not intended to indicate or imply relative importance or significance. Thus, the feature defined with "first" and "second" may comprise one or more this feature. In the description of the present disclosure, "a plurality of" means two or more than two, unless specified otherwise.

In the description of the present disclosure, it should be understood that, unless specified or limited otherwise, the terms "mounted," "connected," and "coupled" and variations thereof are used broadly and encompass such as mechanical or electrical mountings, connections and couplings, also can be inner mountings, connections and couplings of two components, and further can be direct and indirect mountings, connections, and couplings, which can be understood by those skilled in the art according to the detail embodiment of the present disclosure.

In the following, a refrigeration device according to embodiments of the present disclosure will be described in detail with reference to FIGS. 1-8. In the following description of the present disclosure, take a freezer as an example of the refrigeration device to describe. Those skilled in the art should understand that, the refrigeration device according to embodiments of the present disclosure may be other type, such as a refrigeration counter, a refrigeration cabinet, a safety box, a refrigerator, etc.

Figure 3:
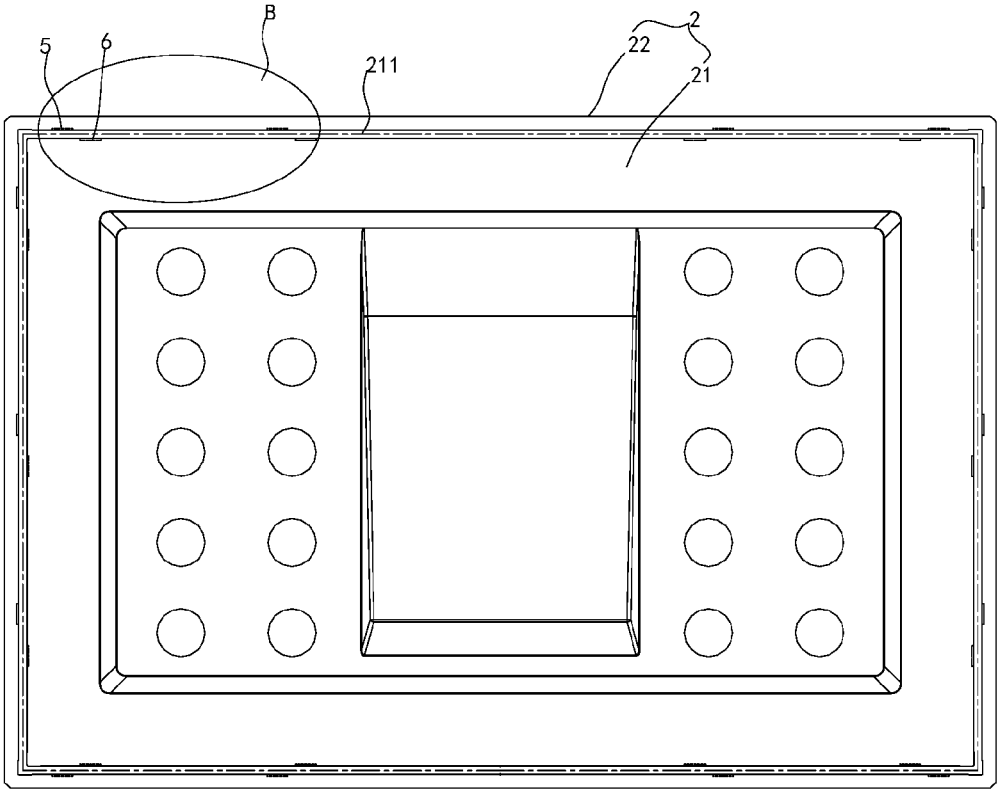
FIG. 3 is a bottom view of the door body of the refrigeration device in FIG. 1.
Figure 4:
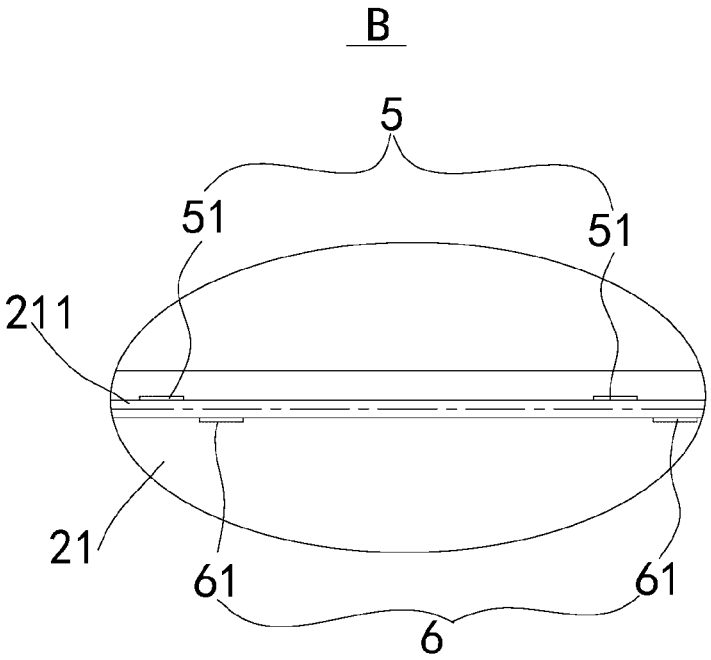
FIG. 4 is an enlarged view of a region B shown in a circle in FIG. 3.

The refrigeration device according to embodiments of the present disclosure includes: a shell 1, a door body 2 configured to open and close the shell 1 and a door seal 3. As shown in FIG. 1, a top portion of the shell 1 is open for storing food. The door body 2 is pivotally connected to the top portion of the shell 1, for example, the door body 2 is connected to the top portion of the shell 1 via a door hinge 8. The door body 2 includes a door housing 22 and a door liner 21 disposed in the door housing 22, in which a groove 211 recessed upwardly is formed on a lower surface of the door liner 21 and is adjacent to and surrounds an outer edge of the lower surface of the door liner 21. In other words, the groove 211 is on the lower surface of the door liner 21 and surrounds the door liner 21, as shown in FIGS. 3 and 4. Preferably, a shape of the groove 211 is substantially the same as a shape of the door liner 21, for example, if the door liner 21 has a rectangular shape, the groove 211 also has a rectangular shape, as shown in FIGS. 3 and 4.

Figure 5:
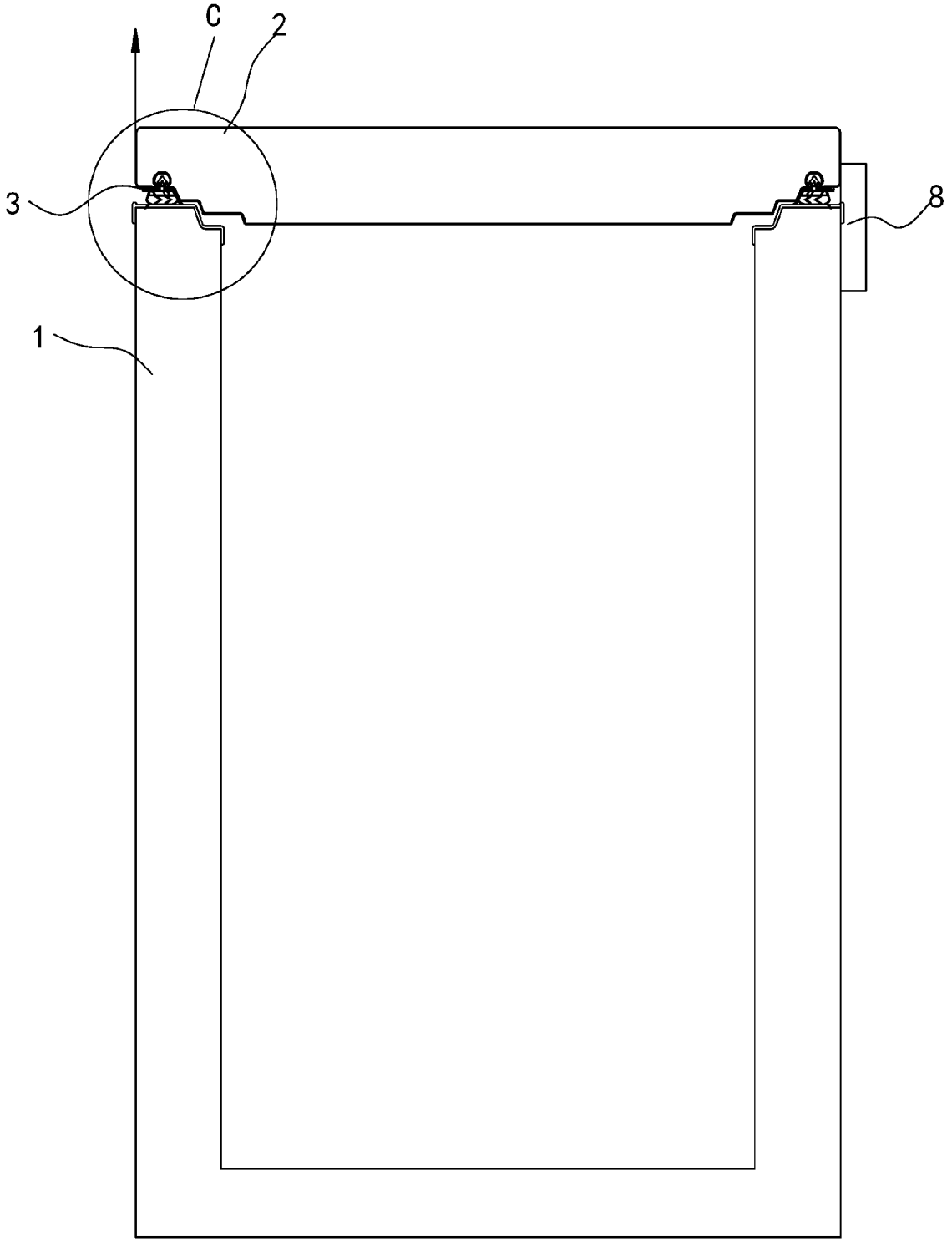
FIG. 5 is a schematic diagram of the refrigeration device shown in FIG. 1, of which the door body is subjected to an upward external force, in which a groove and a door seal coordinated with the groove in a second partial region are illustrated.
Figure 6:
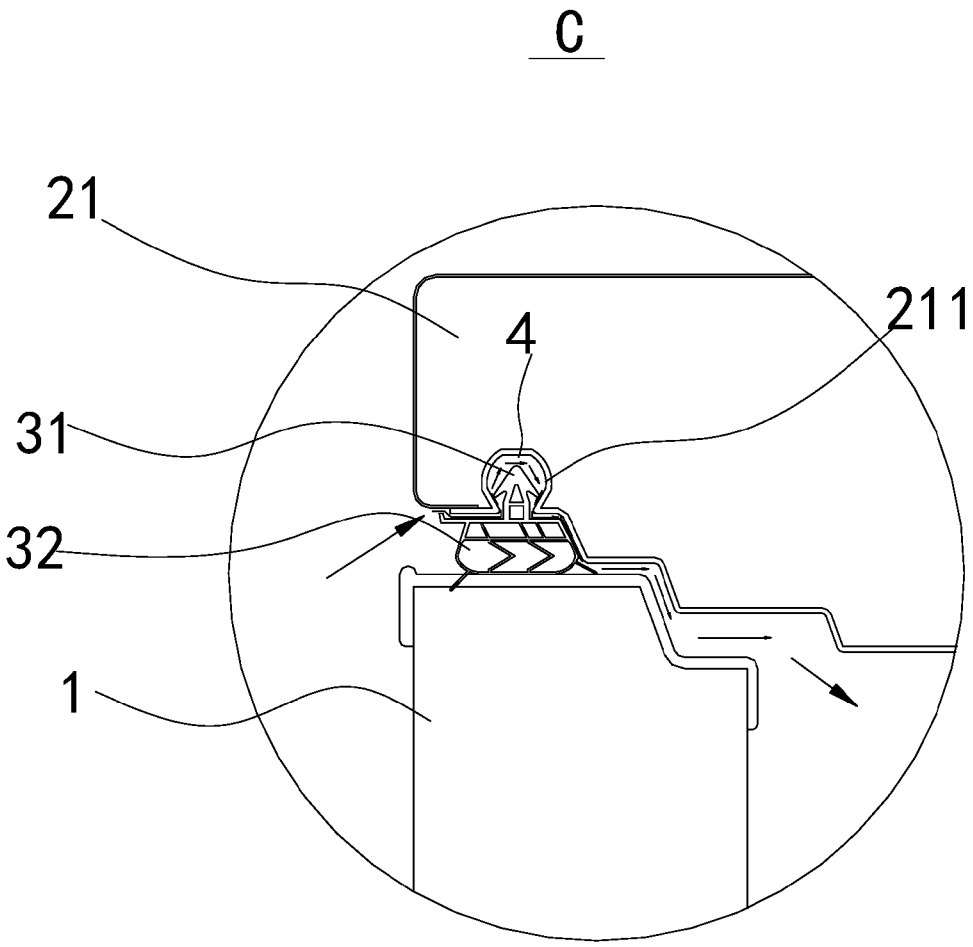
FIG. 6 is an enlarged view of a region C shown in a circle in FIG. 5.
Figure 7:
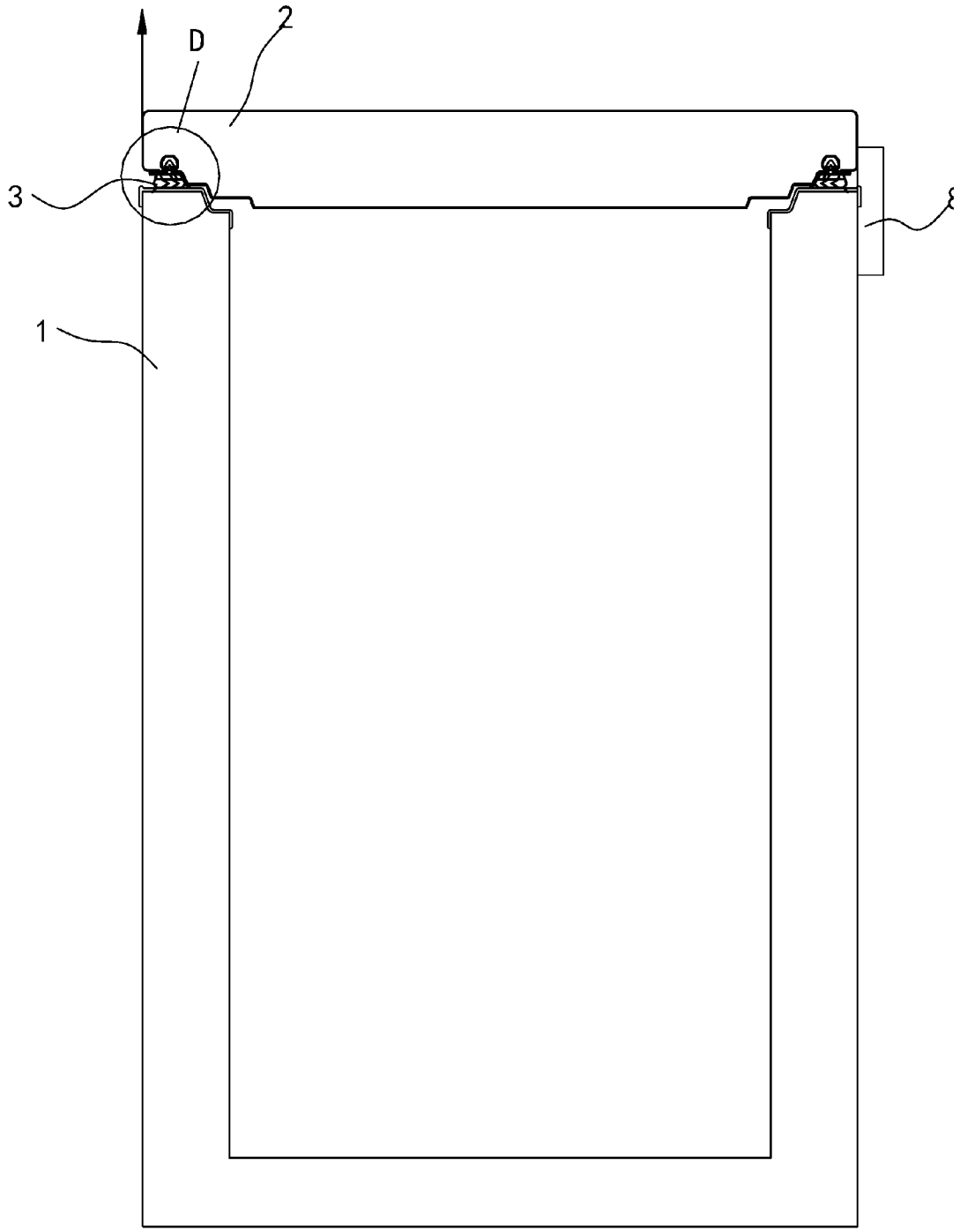
FIG. 7 is a schematic diagram of the refrigeration device shown in FIG. 1, of which the door body is subjected to an upward external force, in which the groove and the door seal coordinated with the groove in a first partial region are illustrated.

As shown in FIGS. 1, 5 and 7, an upper portion of the door seal 3 is snapped in the groove 211, and a lower portion of the door seal 3 is pressed against the top portion of the shell 1 hermetically when the door body 2 is closed, as shown in FIG. 1. An air passage 4 is formed between the door seal 3 and the groove 211 when the door body 2 is subjected to an upward external force, as shown in FIGS. 5 and 6.

Figure 2:
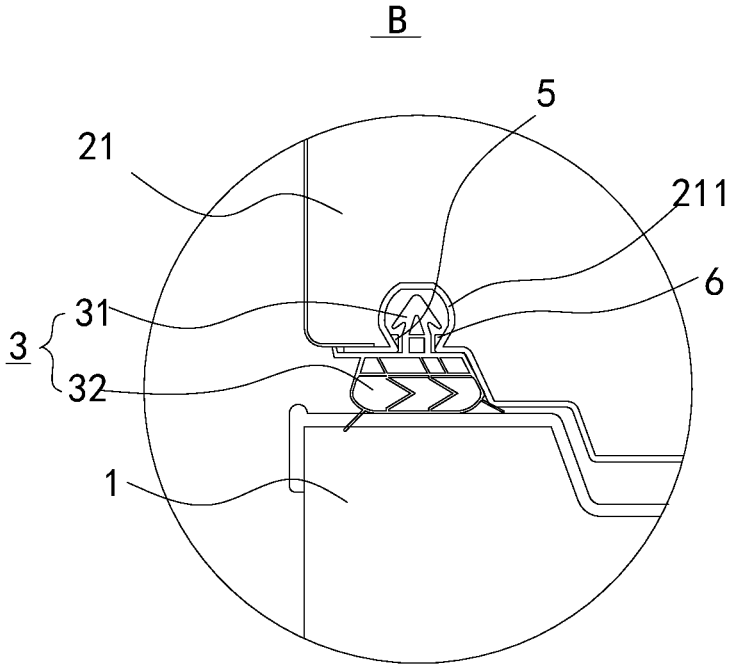
FIG. 2 is an enlarged view of a region A shown in a circle in FIG. 1.

Specifically, as shown in FIGS. 1 and 2, the door body 2 is in a close state, and at this time the door seal 3 is compressed under a pressure due to a weight of the door body 2, so that a seal is formed between the door body 2 and the shell 1, and a hot and cool air exchange between an inside of the shell 1 and an outside environment does not occur, such that the effect for storing food is good. As shown in FIGS. 5 and 6, when the door is needed to be opened, a user may raise the door vigorously, i.e. provide an upward external force to the door, at this time, the air passage 4 is formed between the door seal 3 and the groove 211 and the external air may enter into the shell 1 via the air passage 4, thus balancing the internal pressure and the external pressure of the shell 1, so the door is easy to be opened. Meanwhile, since the upper portion of the door seal 3 is snapped in the groove 211, although there is a relative displacement between the door seal 3 and the door liner 2, the door seal 3 does not escape. In this way, after the door body 2 is closed, the door seal 3 still plays a role of sealing.

With the refrigeration device according to embodiments of the present disclosure, by snapping the upper portion of the door seal 3 in the door liner 2 and generating a relative displacement relative to the door liner 2 to form the air passage 4, such that the external air may enter into the shell 1, thus balancing the internal pressure and the external pressure of the shell 1. In this way, it is easy to open the door and the sealing between the shell 1 and the door body 2 will not be affected when the door body 2 is closed again. In addition, the refrigeration device according to embodiments of the present disclosure is simple to manufacture and low in cost.

Figure 8:
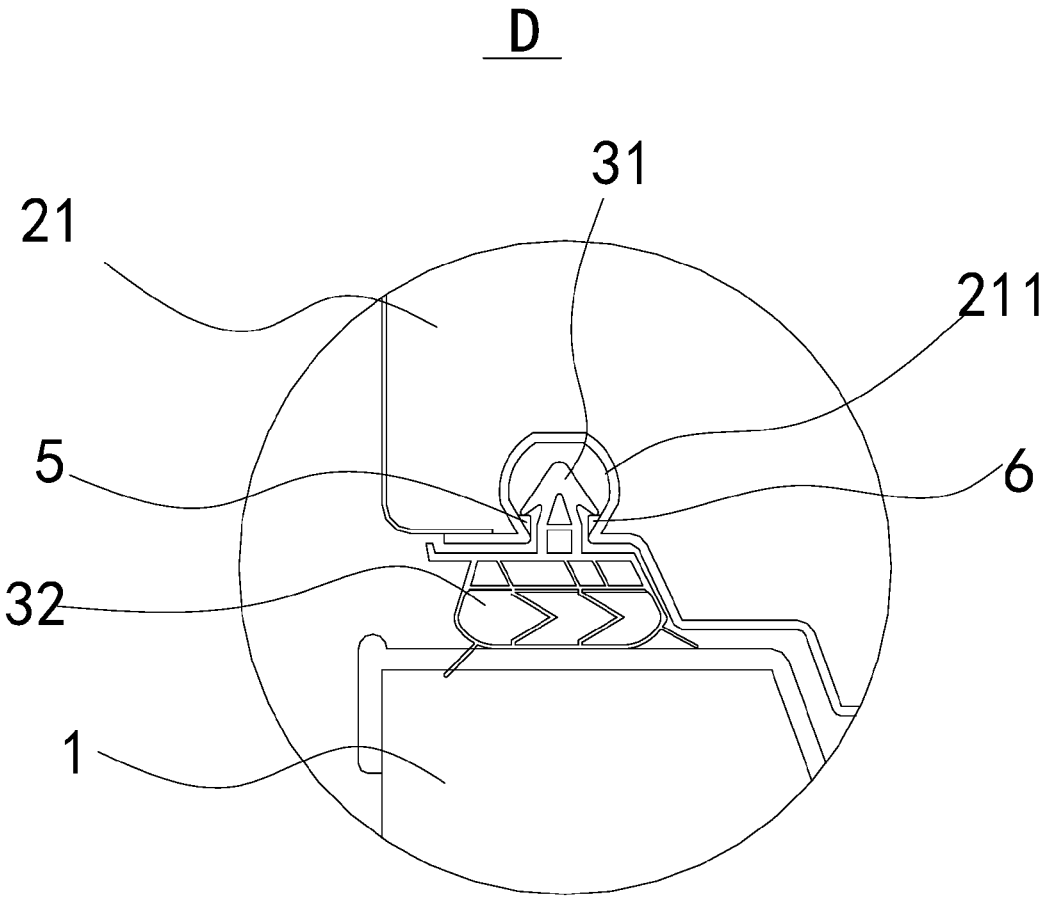
FIG. 8 is an enlarged view of a region D shown in a circle in FIG. 7.

In some embodiments, as shown in FIGS. 2, 6 and 8, the door seal 3 includes: a claw member 31 and an airbag member 32, in which the claw member 31 is snapped in the groove 211, and the airbag member 32 is disposed below the claw member 31, and the airbag member 32 is pressed to the top portion of the shell 1 to form the seal between the door body 2 and the shell 1 when the door body 2 is closed. Preferably, an upper portion of a cross-section of the groove 211 is substantially semicircular and a lower portion of the cross-section of the groove 211 is narrowed. Thus, after the claw member 31 is snapped in the groove 211, it is difficult for the claw member 31 to escape.

The refrigeration device according to embodiments of the present disclosure further includes a first convex portion 5 and a second convex portion 6, in which the first convex portion 5 and the second convex portion 6 are accordingly disposed in a portion of the groove 211, as shown in FIGS. 1-2 and FIGS. 7-8, after a portion of the claw member 31 stretches into the groove 211, two ends of the claw member 31 are pressed against the first convex portion 5 and the second convex portion 6 respectively, and the air passage 4 is formed between another portion of the claw member 31 and another portion of the groove 311 when the door body 2 is subjected to the upward external force, as shown in FIGS. 5 and 6.

In other words, in an extending length of the groove 211, as shown in FIGS. 3 and 4, a partial region has the first convex portion 5 and/or the second convex portion 6. For a convenience of description, this partial region is called as a first partial region of the groove 211, and a remaining partial region is called as a second partial region of the groove 211. In the second partial region, the first convex portion 5 and the second convex portion 6 do not exist in the groove 211.

Thus, FIGS. 7 and 8 illustrate the schematic diagram of the groove 211 and the door seal 3 coordinated with which in the first partial region. When the user raises the door body 2 vigorously, the corresponding claw member 31 may be lifted up in the groove 211 but is still pressed against the first convex portion 5 and the second convex portion 6 hermetically because of an existence of the first convex portion 5 and the second convex portion 6, so that the air passage does not appear in the first partial region.

FIGS. 5 and 6 illustrate the schematic diagram of the groove 211 and the door seal 3 coordinated with the groove 211 in the second partial region. When the user raises the door body 2 vigorously, the corresponding claw member 31 may be lifted up in the groove 211 because of a nonexistence of the first convex portion 5 and the second convex portion 6, and then the air passage 4 is formed between the claw member 31 and the inner wall of the groove 211, so that the external air may enter into the shell 1 via the air passage 4, thus balancing the internal pressure and the external pressure of the shell 1, and then by applying a smaller force, the door body 2 may be opened easily.

In some preferable embodiments, as shown in FIGS. 3 and 4, the first convex portion 5 includes a plurality of first sub convex ribs 51, and the plurality of first sub convex ribs 51 are disposed on an inner wall of a side of the groove 211 at intervals to each other; the second convex portion 6 includes a plurality of second sub convex ribs 61, and the plurality of second sub convex ribs 61 are disposed in the groove 211 at intervals to each other. In other words, the above-described first partial region and second partial region are staggered to each other, thus making gas may enter into the shell 1 evenly and achieving the internal pressure and the external pressure balance faster.

Alternatively, the first sub convex rib 51 and the second sub convex rib 61 are formed respectively by extending inwardly from an inner wall of a corresponding side of the groove 211. For example, in some exemplary embodiments, as shown in FIGS. 2 and 8, the first sub convex rib 51 and the second sub convex rib 61 extend inwardly and horizontally, respectively, so that a processing is convenient and a manufacturing is simple. In other exemplary embodiments, the first sub convex rib 51 and the second sub convex rib 61 extend inwardly and tilt upwardly or downwardly, respectively. In other words, the first sub convex rib 51 and the second sub convex rib 61 extend obliquely from an inner wall of a corresponding side of the groove 211 aslant, so that the claw member 31 pressing against the first sub convex rib 51 hermetically and pressing against the second sub convex rib 61 hermetically may be more compact.

The above-described method for forming the first sub convex rib 51 and the second sub convex rib 61 is not limited in the present disclosure. For example, the first sub convex rib 51 and the second sub convex rib 61 may be formed by injection molding with a formation of the groove 211, i.e. the first sub convex rib 51 and the second sub convex rib 61 are integrally formed with the groove 211. Alternatively, the first sub convex rib 51 and the second sub convex rib 61 may also be separate components respectively, and may be attached into the grooves 211.

In addition, in some embodiments, the first sub convex rib 51 and the second sub convex rib 61 are symmetrical with respect to the door seal therebetween, i.e., the first sub convex rib 51 and the second sub convex rib 61 are symmetrical along a center line of the groove 211. In another embodiments, the first sub convex rib 51 and the second sub convex rib 61 are staggered with respect to the door seal therebetween, i.e., the first sub convex rib 51 and the second sub convex rib 61 are dissymmetrical along the center line of the groove 211, for example, as shown in FIG. 4, the first sub convex rib 51 and the second sub convex rib 61 are staggered on both sides of the groove 211.

In the following, an opening process of the door body in the refrigeration device according to embodiments of the present disclosure will be described in detail with reference to FIGS. 1-8.

Firstly, when the door body 1 is in the close state, as shown in FIGS. 1 and 2, the door seal 3 is compressed under the pressure due to the weight of the door body 2, so that the seal is formed between the door body 2 and the shell 1, and the hot and cool air exchange between the inside of the shell 1 and the outside environment does not occur, such that the effect for storing food is good.

When the door body 1 is needed to be opened, the user may raise the door vigorously, i.e. provide an upward external force to the door (arrows shown in FIGS. 5 and 7), at this time, the air passage 4 is formed between the door seal 3 and the groove 211 and the external air may enter into the shell 1 via the air passage 4, thus balancing the internal pressure and the external pressure of the shell 1, so the door is easy to be opened. Meanwhile, since the upper portion of the door seal 3 is snapped in the groove 211, although there is the relative displacement between the door seal 3 and the door liner 2, the door seal 3 does not escape. In this way, after the door body 2 is closed, the door seal 3 still plays the role of sealing.

Other components of the refrigeration device according to embodiments of the present disclosure, such as the shell, an evaporator, a condenser, etc., as well as operations thereof are well known for those skilled in the art, not be described in detail herein.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present invention. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present invention. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present invention, and changes, alternatives, and modifications can be made in the embodiments without departing from spirit, principles and scope of the present invention.

What is claimed is:

1. A refrigeration device, comprising:

a shell having an open top portion;

a door body configured to open and close the shell and pivotally connected to the top portion of the shell, wherein the door body comprises a door liner, a groove recessed upwardly is formed on a lower surface of the door liner and is adjacent to and surrounds an outer edge of the lower surface of the door liner, wherein an upper portion of a cross-section of the groove is substantially semicircular and a lower portion of the cross-section of the groove is narrowed;

a door seal, wherein an upper portion of the door seal is snapped in the groove, a lower portion of the door seal is pressed against the top portion of the shell hermetically when the door body is closed, and an air passage is formed between the door seal and the groove when the door body is subjected to an upward external force, and the door seal further includes: a claw member snapped in the groove, and an airbag member disposed below the claw member, wherein the airbag member is pressed to the top portion of the shell to form a seal between the door body and the shell when the door body is closed;

a first convex portion, wherein the first convex portion comprises a plurality of first sub convex ribs, and the plurality of first sub convex ribs are disposed on an inner wall of a side of the groove at intervals to each other; and a second convex portion, wherein the first convex portion and the second convex portion are each correspondingly disposed in a portion of the groove, the second convex portion comprises a plurality of second sub convex ribs, and the plurality of second sub convex ribs are disposed in the groove at intervals to each other;

wherein two ends of the claw member are pressed against the first convex portion and the second convex portion respectively after a portion of the claw member stretches into the groove;

wherein the air passage is formed between another portion of the claw member and another portion of the groove when the door body is subjected to the upward external force.

2. The refrigeration device according to claim 1, wherein each first sub convex rib and each second sub convex rib are formed respectively by extending inwardly from an inner wall of a corresponding side of the groove.

3. The refrigeration device according to claim 2, wherein the each first sub convex rib and the each second sub convex rib extend inwardly and horizontally, respectively.

4. The refrigeration device according to claim 2, wherein the each first sub convex rib and the each second sub convex rib extend inwardly and tilt upwardly or downwardly, respectively.

5. The refrigeration device according to claim 1, wherein the first sub convex rib and the second sub convex rib are symmetrical with respect to the door seal therebetween.

6. The refrigeration device according to claim 1, wherein the first sub convex rib and the second sub convex rib are staggered with respect to the door seal therebetween.

7. The refrigeration device according to claim 2, wherein the first sub convex rib and the second sub convex rib are symmetrical with respect to the door seal therebetween.

8. The refrigeration device according to claim 3, wherein the first sub convex rib and the second sub convex rib are symmetrical with respect to the door seal therebetween.

9. The refrigeration device according to claim 4, wherein the first sub convex rib and the second sub convex rib are symmetrical with respect to the door seal therebetween.

10. The refrigeration device according to claim 2, wherein the first sub convex rib and the second sub convex rib are staggered with respect to the door seal therebetween.

11. The refrigeration device according to claim 3, wherein the first sub convex rib and the second sub convex rib are staggered with respect to the door seal therebetween.

12. The refrigeration device according to claim 4, wherein the first sub convex rib and the second sub convex rib are staggered with respect to the door seal therebetween.

* * * * *